US005180208A

United States Patent [19]

Lawandi

[11] Patent Number: 5,180,208

[45] Date of Patent: Jan. 19, 1993

[54] QUICK-DISCONNECT KNOCKDOWN FURNITURE HAVING A FLEXIBLE SUPPORT WITH A PLURALITY OF FRAME MEMBER STORAGE POCKETS

[76] Inventor: Victor Lawandi, 2140 Robichaud, St-Laurent, Quebec, Canada, H4K 2H1

[21] Appl. No.: 650,585

[22] Filed: Feb. 5, 1991

[51] Int. Cl.[5] ..... A47C 7/00

[52] U.S. Cl. ..... 297/440; 297/441; 403/322

[58] Field of Search ..... 297/17, 29, 45, 218, 297/440, 441, 443, 444, 188, 192, DIG. 6; 285/319, 320, 423, 921; 403/322, 325, 327

[56] References Cited

U.S. PATENT DOCUMENTS

| | | | |
|---|---|---|---|
| 576,657 | 2/1897 | Chapman | 297/192 |
| 1,493,467 | 5/1924 | Batt et al. | 297/54 |
| 2,564,915 | 8/1951 | Nelson . | |
| 2,740,466 | 4/1956 | Du Priest | 297/188 |
| 2,742,956 | 4/1956 | Cannata . | |
| 2,982,455 | 5/1961 | Rosen | 297/192 |
| 3,695,702 | 10/1972 | Ingellis | 297/440 X |
| 3,884,159 | 5/1975 | Faria | 108/67 X |
| 4,784,436 | 11/1988 | Sutherland | 297/45 X |
| 4,925,239 | 5/1990 | Powers | 297/29 |

*Primary Examiner*—Kenneth J. Dorner
*Assistant Examiner*—James M. Gardner
*Attorney, Agent, or Firm*—Samuel Meerkreebs

[57] ABSTRACT

A knockdown furniture, such as a chair, comprises a series of elongated tubular members adapted to be interconnected with quick release automatically locking couplings to form a frame of the furniture. A canvas panel having end sleeves can be mounted to the frame to provide a support surface, such as a seat panel, of the furniture. Pockets are provided on one side of the support panel, such as the underside of the seat panel, in order to receive the individual tubular members when the furniture is disassembled. A zipper which is provided at opposed end edges of the support panel is used to form a sleeve therewith which contains the pockets and thus the tubular members, thereby resulting in a compact storage of the dismantled furniture.

13 Claims, 4 Drawing Sheets

QUICK-DISCONNECT KNOCKDOWN FURNITURE HAVING A FLEXIBLE SUPPORT WITH A PLURALITY OF FRAME MEMBER STORAGE POCKETS

BACKGROUND OF THE INVENTION

1. Field of the Invention

The present invention relates to knockdown furniture and, more particularly, to improvements in the assembly and storage thereof.

2. Description of the Prior Art

Knockdown furniture articles such as chairs are well known in the art. Indeed, various constructions have been proposed to form a chair from elongated tubular members which are joined together by coupling devices such as elbows and T's to form the frame of the chair, with one or more canvas panels having end sleeves being engaged to the frame to provide a seat and a back rest. When dismantled, the knockdown furniture constitutes a large number of separate parts which are cumbersome to carry and to store. Some solutions have been proposed to regroup those loose parts in a single container in view of overcoming the above problem.

For instance, U.S. Pat. No. 2,742,956, issued on Apr. 24, 1956 to Cannata, discloses a knockdown chair including a series of tubular members of different diameters which form the frame of the chair. A hollow head is provided at the top end of the largest tubular member through which the remaining tubular members can be slidably inserted one inside the other. The flexible seat and back rest are rolled and disposed within the smallest tubular member. The fittings, which include elbows and T's, and the mounting pins therefor are placed in bulk in the hollow head. A closure is threadably engaged at the top of the hollow head to close the formed container.

U.S. Pat. No. 4,784,436, issued on Nov. 15, 1988 to Sutherland, discloses a knockdown chair and a cylindrical bag for storing the dismantled chair. The cylindrical bag has no function when the chair is in use.

U.S. Pat. No. 2,564,915, issued on Aug. 21, 1951 to Nelson discloses various couplings for joining telescoping male and female portions of the tubular members which form the knockdown chair. Proposed are spring mounted pins and balls which are adapted to engage registered bores. Friction rings are also disclosed.

SUMMARY OF THE INVENTION

It is therefore an aim of the present invention to provide a knockdown furniture which, when dismantled, is easy to carry and store.

It is also an aim of the present invention to provide a knockdown furniture in which a flexible support panel, such as a seat or a back rest, of the assembled furniture is also used to carry the various parts thereof, when dismantled.

It is a further aim of the present invention to provide a knockdown furniture having improved quick release couplings for mounting the various parts thereof one to the other.

A construction in accordance with the present invention comprises a knockdown furniture including a series of elongated members adapted to be slidably interconnected for forming a frame of the furniture. A flexible panel means is adapted to be mounted to the frame in order to form a support means of the furniture. The flexible panel means is adapted to be joined at two opposed end sections thereof for forming a sleeve. The sleeve forms a pocket means which is adapted to receive the elongated members.

In another construction in accordance with the present invention, there is provided a knockdown furniture which comprises a series of elongated members adapted to be interconnected in order to form a frame of the furniture. A flexible panel means is adapted to be mounted to the frame for forming a support means of the furniture. Connecting means are provided at two opposed end sections of the flexible panel means. Therefore, in a storage position, the end sections are joined one to the other by the connecting means to form a pouch means for receiving the elongated members.

In a more specific construction in accordance with the present invention, a pocket means provided on a side of the flexible panel means between the end sections is adapted in the storage position to be located within the pouch means for receiving at least some of the elongated members.

In a more specific construction in accordance with the present invention, at least some of the elongated members, in the storage position, are disposed in the pocket means with a remainder thereof, if any, being maintained in the pouch means by pressure exerted by the flexible panel means.

In a still more specific construction in accordance with the present invention, the connecting means comprises a zipper.

In a still more specific construction in accordance with the present invention, the pocket means comprises a plurality of similar parallel pockets positioned side by side on the side of the flexible panel means. In a particular construction, the pockets are detachably mounted to the flexible panel means by way, for instance, of "Velcro" type connectors.

In a still further construction in accordance with the present invention, the flexible panel means forms parallel sleeves along two opposed ends thereof. The sleeves are slidable over a pair of elongated members in order to mount the flexible panel means to the frame.

In a still more specific construction in accordance with the present invention, the elongated members and the flexible panel means are respectively made of a plastics and a canvas-like material.

In a more specific construction in accordance with the present invention, the elongated members are cylindrical. Some of the cylindrical members include projecting male terminal portions adapted to engage quick release coupling devices provided at ends of cooperating cylindrical members for slidably assembling the frame.

In a still more specific construction in accordance with the present invention, the male terminal portions are provided with a circumferential radially extending annular rib. The ends of the cooperating cylindrical members comprise female terminal portions slidable over the male terminal portions. The coupling devices include spring biased locking sleeves disposed around the female terminal portions, resilient means provided between the locking sleeves and the female terminal portions with the resilient means engaging slot means defined in the female terminal portions. The locking sleeves are displaceable between disengagement and locking positions. In the locking position, the locking sleeve prevents an outward radial displacement of the resilient means with the resilient means extending through the slot means towards the male terminal portion in order to cooperate with the rib to prevent the male and female terminal portions from being disengaged. In the disengagement position, the locking sleeve is retracted to permit a radial outward displacement of the resilient means away from the male terminal portion thereby providing clearance for the rib and thus allowing the male and female terminal portions to be slidably disengaged.

In a still more specific construction in accordance with the present invention, the frame is adapted to form a chair with the flexible panel means forming a seat thereof. A further flexible panel means being adapted to be mounted to the frame for forming a back rest of the chair.

Another construction in accordance with the present invention provides a knockdown furniture, wherein the assembly includes the package in the form of a flexible container means forming a pouch means. A series of elongated members within the container means are adapted to be interconnected for forming a frame. The container means is adapted to be mounted to the frame for forming a support means of the furniture.

In a more specific construction in accordance with the present invention, the pouch means is formed from a flexible panel means which, in a storage position, is joined at two opposed end sections thereof with disengageable cooperating connecting means being provided thereat. The flexible panel means is adapted to be mounted to the frame when the end sections are disengaged.

In a still more specific construction in accordance with the present invention, at least one pocket means is provided on a side of the flexible panel means within the pouch means for receiving at least some of the elongated members with a remainder, if any, of the elongated members being disposed in the pouch means exteriorly of the pocket means.

BRIEF DESCRIPTION OF THE DRAWINGS

Having thus generally described the nature of the invention, reference will now be made to the accompanying drawings showing by way of illustration only a preferred embodiment thereof, and in which.

DESCRIPTION OF THE PREFERRED EMBODIMENTS

Figure 1:
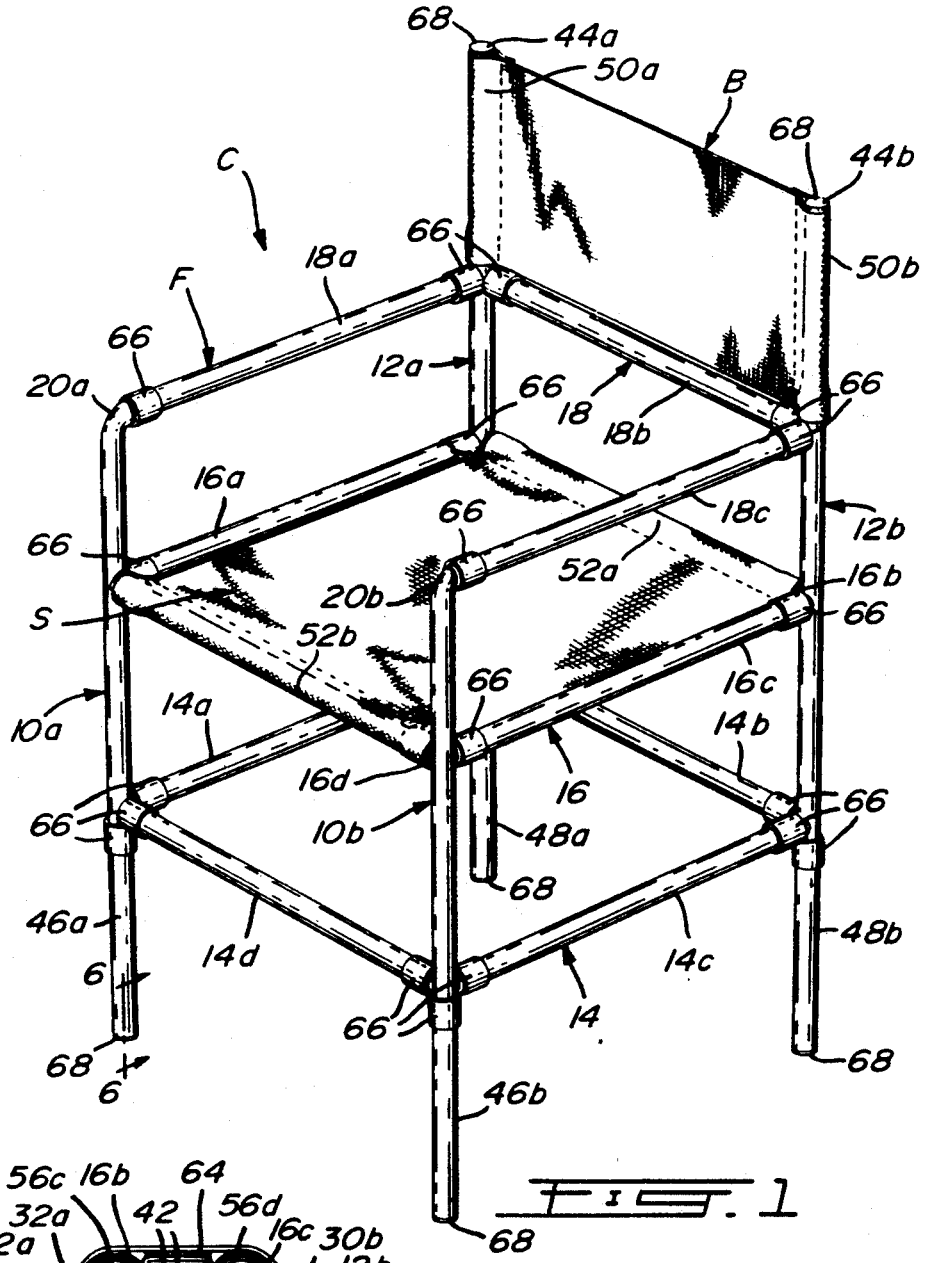
FIG. 1 is a perspective view of a knockdown chair in an assembled state thereof in accordance with the present invention.

FIG. 1 illustrates a knockdown chair C in its assembled state in accordance with the present invention. The assembled chair C includes a frame F and fabric seat and back panels S and B, respectively, which are mounted thereto.

Generally, the frame F is made up of a series of elongated tubular members which are interconnectable by way of quick release couplings which will be described in details hereinafter.

More particularly, the frame F includes two identical vertical front tubular members 10*a* and 10*b* and two identical vertical rear tubular members 12*a* and 12*b*. The front and rear tubular members 10*a*, 10*b*, 12*a* and 12*b* are joined at first, second and third horizontal levels 14, 16 and 18, respectively, by identical tubular members, as described hereinbelow.

The first and second horizontal levels 14 and 16 each includes four tubular members 14*a*, 14*b*, 14*c* and 14*d*, and 16*a*, 16*b*, 16*c* and 16*d*, respectively. The third horizontal level 18 includes three tubular members 18*a*, 18*b* and 18*c*. The horizontal tubular members having the suffix "a" or "c" are side members, whereas the horizontal tubular members having the suffix "b" and "d" are respectively rear and front members, as best seen in FIG. 1.

Figure 3:
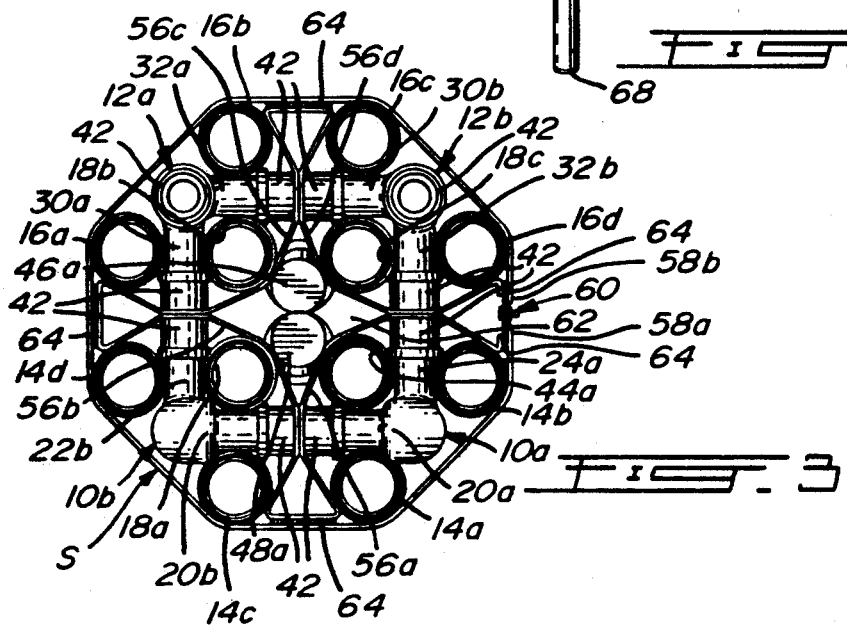
FIG. 3 is an elevation of the dismantled chair of FIG. 2 in a storage position.
Figure 2:
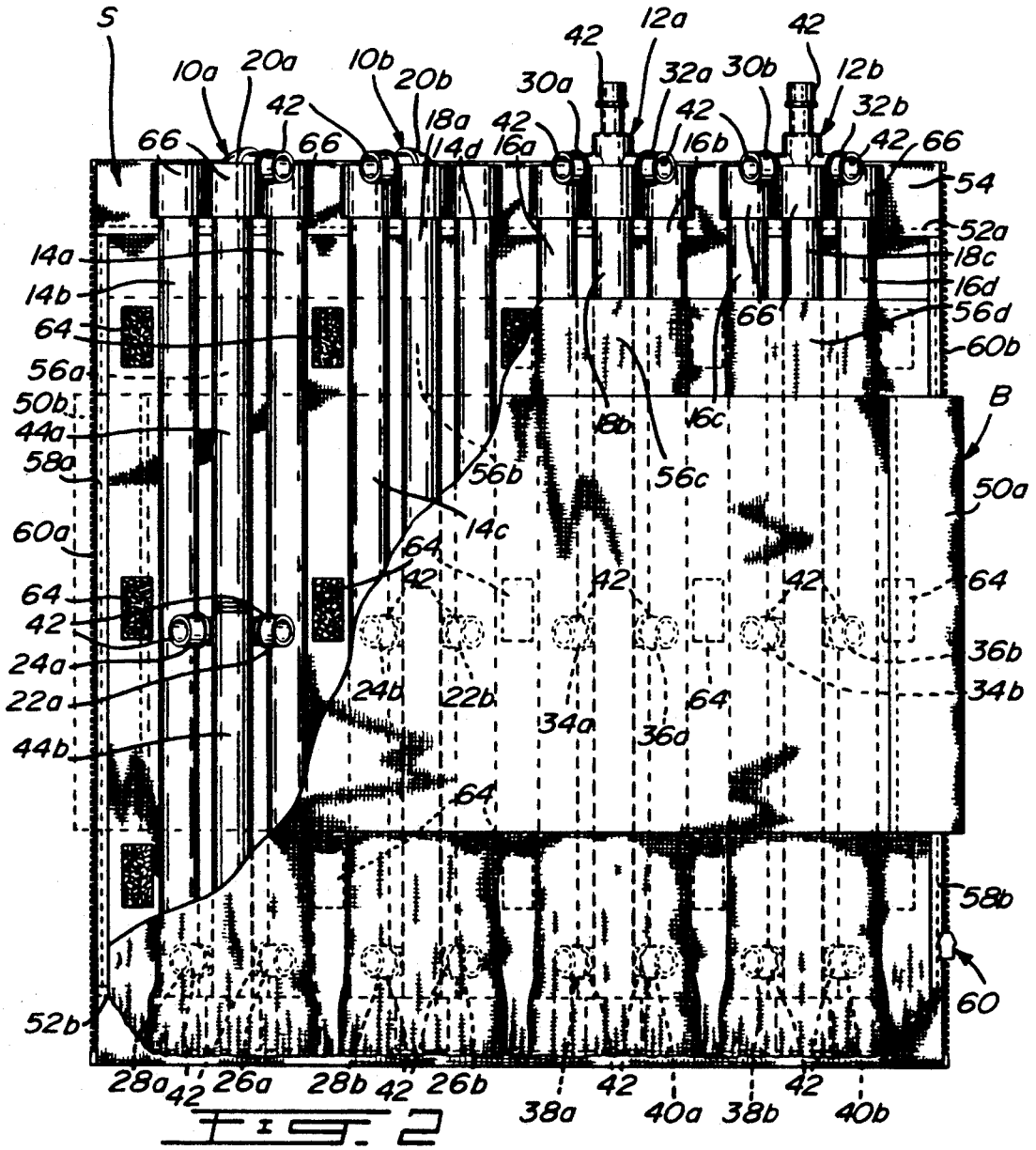
FIG. 2 is a fragmented plan view similar to FIG. 2*a* but showing the frame sections of the dismantled chair inserted in the pockets of the seat panel, and showing the back panel overlying the seat panel.

Referring to FIGS. 1 to 3, the front vertical tubular members 10*a* and 10*b* each includes a respective upper elbow 20*a* and 20*b*, a respective pair of horizontal perpendicular middle side arms 22*a* and 24*a* and 22*b* and 24*b*, and a respective pair of horizontal perpendicular lower side arms 26*a* and 28*a* and 26*b* and 28*b*.

The rear vertical tubular members 12*a* and 12*b* each include a respective pair of horizontal perpendicular upper side arms 30*a* and 32*a* and 30*b* and 32*b*, a respective pair of horizontal perpendicular middle side arms 34*a* and 36*a* and 34*b* and 36*b*, and a respective pair of horizontal perpendicular lower side arms 38*a* and 40*a* and 38*b* and 40*b*.

Each of the above upper front elbows 20*a* and 20*b*, upper rear side arms 30*a*, 30*b*, 32*a* and 32*b*, middle front side arms 22*a*, 22*b*, 24*a* and 24*b*, middle rear side arms 34*a*, 34*b*, 36*a* and 36*b*, lower front side arms 26*a*, 26*b*, 28*a* and 28*b*, and lower rear side arms 38*a*, 38*b*, 40*a* and 40*b* each project an identical tubular male terminal portion 42, as described in details hereinafter.

Identical tubular male terminal portions 42 also project vertically upwards from the top ends of the rear vertical tubular members 12*a* and 12*b*, as seen in FIG. 2, and downwards from the lower ends of the front and rear vertical tubular members 10*a*, 10*b*, 12*a* and 12*b*.

As best seen in FIG. 1, the frame F is completed with two upper vertical tubular members 44*a* and 44*b* which basically constitute upward extensions of the rear vertical tubular members 12*a* and 12*b*, respectively. Also, four lower vertical tubular members 46*a*, 46*b*, 48*a* and 48*b* extend respectively downwards from the front and rear vertical tubular members 10*a*, 10*b*, 12*a* and 12*b*.

These upper and lower vertical tubular members 44*a*, 44*b*, 46*a*, 46*b*, 48*a* and 48*b* are of equal length and each include at one end a tapered tubular female terminal portion slidable over a respective one of the male terminal portions 42. The horizontal tubular members 14*a*, 14*b*, 14*c*, 14*d*, 16*a*, 16*b*, 16*c*, 16*d*, 18*a*, 18*b* and 18*c* are also of equal length but are twice as long as the previous upper and lower tubular members 44*a*, 44*b*, 46*a*, 46*b*, 48*a* and 48*b*. The horizontal tubular members 14*a*, 14*b*, 14*c*, 14*d*, 16*a*, 16*b*, 16*c*, 16*d*, 18*a*, 18*b* and 18*c* are each provided at both their ends with a tubular tapered female terminal portion slidable over the male terminal portions 42. Each of the female terminal portions of the tubular members 14*a*, 14*b*, 14*c*, 14*d*, 16*a*, 16*b*, 16*c*, 16*d*, 18*a*, 18*b*, 18*c*, 44*a*, 44*b*, 46*a*, 46*b*, 48*a* and 48*b* includes a retractable locking sleeve 66 which constitutes a coupling between each corresponding male and female terminal portions, and which will be described in details hereinbelow.

The back panel B defines a pair of sewn end sleeves 50*a* and 50*b* which, in the assembled state of the chair C of FIG. 1, are slidably engaged over the upper vertical tubular members 44*a* and 44*b*. Similarly, the seat panel S also defines a pair of sewn end sleeves 52*a* and 52*b* which are slidably engaged on the horizontal tubular members 16*b* and 16*d* of the third horizontal level 16 of the frame F.

Figure 2A:
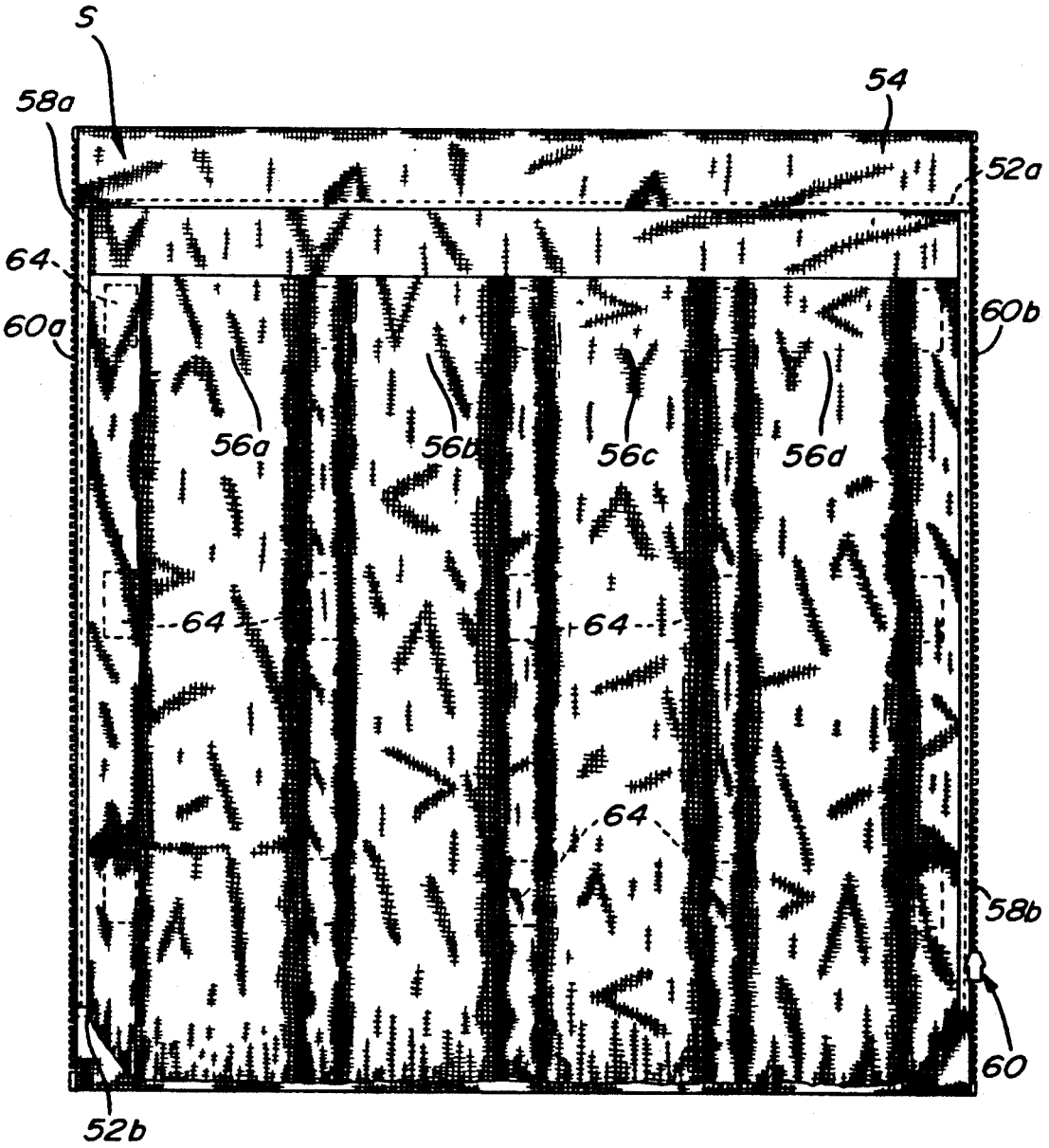
FIG. 2*a* is a plan view showing the underside of the seat panel of the chair of FIG. 1.

FIGS. 2*a*, 2 and 3 illustrate various stages of the chair C in its dismantled state. FIG. 2*a* shows an underside 54 of the seat panel S provided with four similar pockets 56*a*, 56*b*, 56*c* and 56*d* which are disposed side by side and which extend between the seat sleeves 52*a* and 52*b* at right angles thereto. Side edges 58*a* and 58*b* of the seat panel S which are parallel to the pockets 56*a*, 56*b*, 56*c* and 56*d* are provided with complementary cooperating zipper portions 60*a* and 60*b* for forming a zipper 60.

Now referring to FIG. 2, each one of the four pockets 56*a*, 56*b*, 56*c* and 56*d* can accommodate a respective one of the front and rear vertical tubular members 10*a*, 10*b*, 12*a* and 12*b*. Also, in the illustrated embodiment, each one of the pockets 56*b*, 56*c* and 56*d* accommodates three tubular members of the eleven horizontal tubular members 14*a*, 14*b*, 14*c*, 14*d*, 16*a*, 16*b*, 16*c*, 16*d*, 18*a*, 18*b* and 18*c*, whereas the pocket 56*a* receives the remaining two horizontal members and also the two upper vertical tubular members 44*a* and 44*b* which are disposed coaxially therein. The back panel B is positioned to overlie the seat panel S.

As seen in FIG. 3, the seat panel S can be wrapped to form a sleeve or a pouch enclosing the pockets 56*a*, 56*b*, 56*c* and 56*d* and their respective tubular members and secured in that position by way of the zipper 60. The remaining four members, that is the four lower vertical tubular members 46*a*, 46*b*, 48*a* and 48*b*, are aligned two by two and maintained in the middle of the formed sleeve and, more particularly, in the cavity 62 formed between the pockets. The back panel B is also to be contained in the cavity 62.

The pockets 56*a*, 56*b*, 56*c* and 56*d* although they can be sewn or mounted with buttons or snaps to the seat panel S are detachably mounted thereto in the illustrated embodiment by way of a fastening material 64 such as "VELCRO"] (Registered Trademark).

Figure 6:
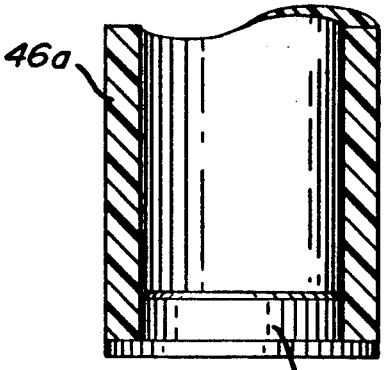
FIG. 6 is a cross-sectional view taken along lines 6—6 of FIG. 1 of a lower leg of the chair.

As best seen in FIGS. 1 and 2, both ends of the horizontal tubular members 14*a*, 14*b*, 14*c*, 14*d*, 16*a*, 16*b*, 16*c*, 16*d*, 18*a*, 18*b* and 18*c* and appropriate single ends of short vertical upper and lower tubular members 44*a*, 44*b*, 46*a*, 46*b*, 48*a* and 48*b* define female terminal portions provided with the aforementioned identical disengageable locking sleeves 66. Other ends of the tubular members 44*a*, 44*b*, 46*a*, 46*b*, 48*a* and 48*b* are provided with end caps 68 (see FIGS. 1 and 6).

Each combination of a male terminal portion 42 and a locking sleeve 66 constitutes a quick release coupling for detachably securing the various above tubular members one to the other to form the assembled chair C of FIG. 1. A typical connection of the male and female terminal portions with a sleeve 66 of, for example, the middle side arm 24*b* of the front vertical tubular member 10*b* with the middle horizontal tubular member 16*c* is illustrated in details in FIGS. 4 and 5.

The male terminal portion 42 defines an annular rib 70. The locking sleeve 66 is disposed around the end of the tubular member 16*c* which defines a circumferential recess 72 having a radial wall 74 and a sloped wall 76. The tubular member 16*c* includes a flange 78 near its end.

The locking sleeve 66 includes four identical nose portions 80 which project radially inwardly therefrom. Each nose portion 80 has a (sloped wall 82 and a radial wall 84. A washer 86 projects radially inwards from the locking sleeve 66. A coil spring 88 is disposed transversely between the tubular member 16*c* and the locking sleeve 66, and longitudinally between the flange 78 and the washer 86.

Figure 5:
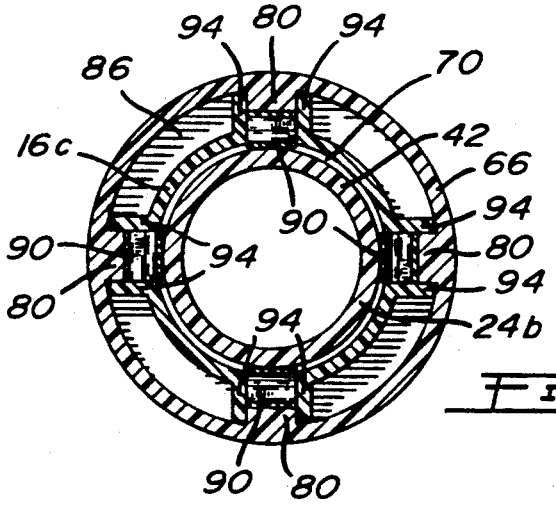
FIG. 5 is a cross-sectional view taken along lines 5—5 of FIG. 4 of the coupling.

Four identical spring clips 90 are disposed in respective slots 92 defined in the end of the tubular member 16*c*. Each spring clip 90 which has an outward plane surface in abutment with the plane surface of the nose portion 80 is held laterally in place by pairs of spaced apart parallel flanges 94 disposed on each side thereof, as best seen in FIG. 5.

Figure 4:
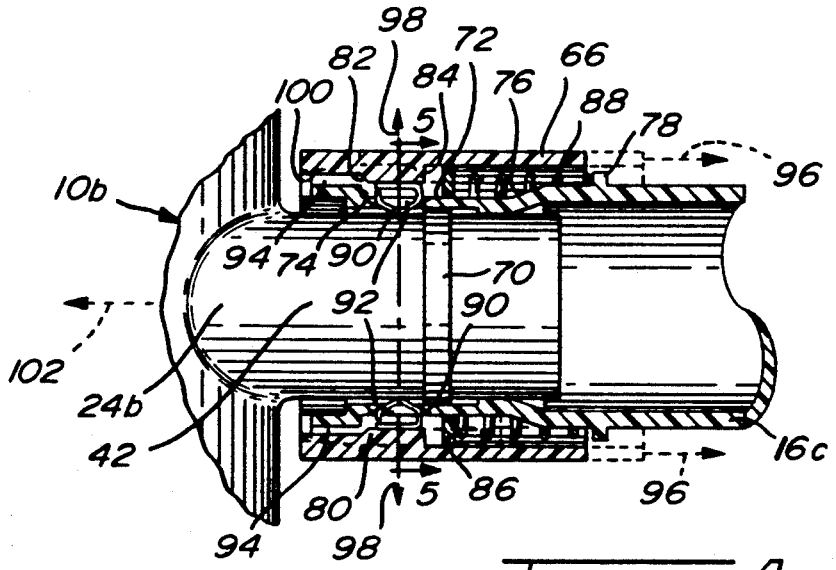
FIG. 4 is an axial cross-section of a coupling in accordance with the present invention.

Therefore, when the locking sleeve 66 is in its position shown in full lines on FIG. 4, the spring clips 90 remain engaged in the slots 92 by way of the nose portions 80 which prevent any outward movement thereof, whereby the spring clips 90 contact the male terminal portion 42 with the rib 70 thereof preventing the male and female terminal portions from being slidably disengaged. The coil spring 88 biases the locking sleeve 66 in its longitudinally forward locking position.

To separate the male and female terminal portions and thus the tubular members 16*c* and 10*b*, the locking sleeve 66 is displaced rearward along arrows 96 against the coil spring 88, thereby allowing the spring clips 90 to displace radially outwards as they slide along the sloped walls 82 of the locking sleeve 66 as shown by arrows 98 and the phantom lines of FIG. 4. Upon reaching the surfaces 100 of the locking sleeve 66, the spring clips 90 cease to prevent the sliding movement of the rib 70 of the male terminal portion 42 along the inside of the end of the tubular member 16*c*, whereby the male and female terminal portions can be separated (see arrow 102).

It is easily understood from the above that quick release couplings allow for easy assembly and dismantling of the present knockdown chair C. All of the elbows, side arms and couplings are integral to a main tubular member, thereby eliminating any small loose parts. The tubular members can all be enclosed in the pouch or sleeve formed by the seat panel S (see FIG. 3) and in the pockets 66*a*, 66*b*, 66*c* and 66*d* provided therein. Therefore, when the chair C is assembled, there is no separate storage bag to put aside. The above construction provides for a quick assembly, compact and easy storage of a knockdown furniture. This construction is very useful for articles which are not always in use and need to be stored or transported (e.g. camping furniture, summer furniture).

In a further construction embodying the present invention, but which is not herein illustrated, one of the flexible seat or back panels forms a pouch closed along three of its sides. The pouch can be slid over the appropriate elongated members of the frame which results in the supporting panel having two spaced apart plies. In the dismantled state of the furniture, all of the elongated members and the remaining flexible support panel can be introduced in the flexible panel forming this pouch.

Other than a chair C, the present invention can be used to produce beds, lawn chairs, wheel chairs, cribs, emergency beds, tables (in which case the extended fabric panel can be used as a support surface), etc.

I claim:

1. A knockdown furniture comprising a series of elongated members slidably interconnected and forming an entirely storable knockdown frame of said furniture, flexible panel means removably mounted on said frame and forming a support means of said furniture, said flexible panel means including two opposed end sections having connectable fastening means joinable to form a storage sleeve, a plurality of similar parallel pocket means being provided side-by-side on a side on said flexible panel means between said end sections, said pocket means being located within said sleeve when said end sections are joined one to the other in a storage position, said sleeve and said pocket means having a capacity sufficient for receiving all of said elongated members of the knockdown frame when dismantled for ready storage thereof.

2. A knockdown furniture comprising a series of elongated members interconnected and forming an entirely storable knockdown frame of said furniture, flexible panel means removably mounted on said frame and forming a support means of said furniture, joinable connecting means being provided at two opposed end sections of said flexible panel means, a plurality of similar parallel pocket means being provided side by side on said flexible panel means between said end sections, whereby, in a storage position, said end sections are joined one to the other by said connecting means to form pouch means with said pocket means being located within said pouch means, said pouch means and said pocket means having a capacity sufficient for receiving all of said elongated members of the knockdown frame when dismantled for ready storage thereof.

3. A knockdown furniture as defined in claim 2, wherein, in said storage position, at least some of said elongated members are disposed in said pocket means with a remainder thereof, it any, being maintained in said pouch means by pressure exerted by said flexible panel means.

4. A knockdown furniture as defined in claim 2, wherein said connecting means comprises a zipper.

5. A knockdown furniture as defined in claim 2, wherein said pocket means are detachably mounted to said flexible panel means.

6. A knockdown furniture as defined in claim 5, wherein cooperating connectors are provided on said pocket means and on said side of said flexible panel means for removably mounting said pocket means to said flexible panel means.

7. A knockdown furniture as defined in claim 2, wherein said flexible panel means forms parallel sleeves along two opposed ends thereof slidable over a pair of elongated members for mounting said flexible panel means to said frame.

8. A knockdown furniture as defined in claim 2, wherein said elongated members and said flexible panel means are respectively made of a plastics and a canvas-like material.

9. A knockdown furniture as defined in claim 2, wherein said elongated members are cylindrical and are slidably interconnected to one another by cooperating male and female terminal portions provided at respective ends of each pair of elongated members that are joined together, said female terminal portions each comprising a quick release coupling device which slidably receives a respective one of said male terminal portions for assembling said frame.

10. A knockdown furniture as defined in claim 9, wherein said male terminal portions are provided with a circumferential radially extending annular rib, said female terminal portions being slidable over said male terminal portions, said coupling devices including spring biased locking sleeves disposed around said female terminal portions, resilient means being provided between said locking sleeves and said female terminal portions and engaging slot means defined in said female terminal portions, said locking sleeves being displaceable between disengagement and locking positions, wherein, in said locking position, said locking sleeve prevents an outward radial displacement of said resilient means with said resilient means extending through said slot means towards said male terminal portion in order to cooperate with said rib for preventing said male and female terminal portions from being disengaged, and wherein, in said disengagement position, said locking sleeve is retracted to permit a radial outward displacement of said resilient means away from said male terminal portion, thereby providing clearance for said rib and thus allowing said male and female terminal portions to be slidably disengaged.

11. A knockdown furniture as defined in claim 2, wherein said frame is adapted to form a chair with said flexible panel means forming a seal thereof, a further flexible panel means being adapted to be mounted to said frame for forming a back rest of said chair.

12. A knockdown furniture, wherein an assembly includes a package in the form of a flexible container means forming a storage pouch means containing a series of elongated members, wherein, in a functional position of said knockdown furniture, said elongated members are interconnected and form a knockdown frame of said furniture, said container means, in said functional position, being mounted to said frame and forming a support means of said furniture, said pouch means being formed from a flexible panel means which, in a storage position, is joined at two opposed end sections thereof with disengageable cooperating connecting means provided thereat, said flexible panel means being mounted to said frame when said end sections are disengaged, a plurality of similar parallel pocket means being provided side by side on said flexible panel means wherein in said storage position said pouch means and said pocket means receive all of said elongated members when dismantled.

13. A knockdown furniture as defined in claim 12, wherein said pocket means receive at least some of said elongated members with a remainder, if any, of said elongated members being disposed in said pouch means exteriorly of said pocket means.

* * * * *